United States Patent [19]

Easter et al.

[11] Patent Number: 4,869,136

[45] Date of Patent: Sep. 26, 1989

[54] FASTENER GRIPPING MECHANISM FOR BOLT RUNNING OPERATIONS

[75] Inventors: David A. Easter, Westerville; Donald J. Hackman; William R. Dick, both of Columbus; John J. Reidy, Orient, all of Ohio

[73] Assignee: Battelle Memorial Institute, Columbus, Ohio

[21] Appl. No.: 219,147

[22] Filed: Jul. 15, 1988

[51] Int. Cl.[4] ..... B25B 21/00

[52] U.S. Cl. ..... 81/55; 414/729; 279/41 R

[58] Field of Search ..... 81/54, 55, 57.24, 57.4; 279/41 R, 46 R; 294/110.1, 110.2, 116; 414/729, 744 A

[56] References Cited

U.S. PATENT DOCUMENTS 4,320,674 3/1982 Ito et al. ..... 81/54
4,589,817 5/1986 Adinolfi et al. ..... 414/729

FOREIGN PATENT DOCUMENTS 166587 1/1986 European Pat. Off. ..... 81/55

*Primary Examiner*—James G. Smith
*Attorney, Agent, or Firm*—Philip J. Pollick; Robert B. Watkins; Philip M. Dunson

[57] ABSTRACT

A fully automated tool for holding threaded fasteners during fastener insertion, removal, or transport is described. The device is capable of handling different sized fasteners and can be used with remote manipulator systems or in hand-held operations.

24 Claims, 4 Drawing Sheets

FASTENER GRIPPING MECHANISM FOR BOLT RUNNING OPERATIONS

FIELD OF INVENTION

This invention relates generally to fastener driving tools and more particularly to a tool adapted with a collet-based fastener gripping mechanism for positively holding a threaded fastener during remote bolt running operations, i.e., fastener insertion, removal and transport operations in zero gravity or in locations that are humanly inaccessible or difficulty accessible.

BACKGROUND OF THE INVENTION

In the prior art, there are various types of devices for locating, holding, threading and unthreading, and releasing various types of fasteners. U.S. Pat. No. 4,511,255 (Razdobreev, Apr. 16, 1985) discloses a pneumatic collet release tool for use with a milling machine. Such an invention serves to secure and loosen a collet for tool and collet replacement. The invention requires manned intervention to secure the drive spindle, which is distinct from the collet release drive, during the collet or tool securing or release operation. U.S. Pat. No. 4,426,067 (Gaquere, July 2, 1985) reveals a fastener gripping and driving device. Gripping is accomplished by relative rotational movement between upper and lower gripping members. U.S. Pat. No. 4,498,545 (Grassi, Feb. 12, 1985) shows an automatic bolt tightening device for assembling members placed on a buck. U.S. Pat. No. 4,222,294 (Bippus, Sept. 1, 1980) illustrates a gripping means for a socket or other grasping device. U.S. Pat. No. 4,211,425 (Halvorsen, July 8, 1980) shows a collet with front and rear jaws operable by a longitudinally moving push tube which in turn is controlled by an air cylinder. U.S. Pat. No. 3,886,821 (Tokunaga et al. June 3, 1975) reveals a device for detecting and loosening and tightening bolts on concrete molds.

While the prior art shows various collet-type fastener grippers and drivers, it does not reveal a collet-type power tool capable of engaging, gripping, removing, transporting, reinserting, and releasing fasteners nor does it reveal the accomplishment of these tasks in a remote fashion nor the ability to remotely change collets.

SUMMARY OF THE INVENTION

The device of the present invention is a fully automated collet-based tool designed to provide a means for positively holding a threaded fastener such as a hex-head bolt or socket-head cap screw during bolt running operations. Such operations include fastener insertion, removal, and transport. In addition, the collet itself can be remotely replaced in order to handle different sized fasteners. The device can be used with a remote manipulator system or in hand-held operations.

The device consists of a power pack with a drive shaft rotatable in two directions. The drive shaft is threaded into a lock shaft which is contained in a gripper head. The lock shaft serves two purposes: (1) when free to rotate while the gripper head is secured to the power pack, it serves to move a collet longitudinally in a collet support flange thereby securing or releasing a fastener through a radial force exerted on the collet by the support flange, and (2) when locked to the gripper head with a lock pin, the gripper head is free to rotate thereby threading or unthreading the fastener.

When the gripper head is locked to the power pack and the lock shaft is free to rotate within the gripper head, rotation of the lock shaft causes the collet to screw onto the lock shaft thereby drawing the collet into the collet support flange. The collet is slotted to mate with a tang on the collet support flange so as to prevent rotation as it is being drawn into the collet support flange by the screwing action of the lock shaft. Each collet has a socket type head designed to match a specific fastener. The socket-type collet head is slit and has a gradually increasing external radius so that as it is drawn into the collet support flange by the screwing action of the lock shaft, a radial force is applied to the collet head causing it to squeeze down tightly over the fastener and thereby secure it.

By rotating the lock shaft in the opposite direction, the collet is unscrewed from the lock shaft and is forced from the collet support flange thereby allowing the slit collet head to expand and thereby releasing the fastener. By then placing the collet in a collet holder, the collet can be completely removed from the device. By reversing the rotation of the lock shaft, a different collet can be screwed onto the lock shaft for use with a different size fastener.

Once the fastener head is securely held by the collet, the lock shaft is locked to the gripper head and, simultaneously, the gripper head is unlocked from the power head. In this position, the gripper head, collet, and fastener are locked together and are free to rotate in order to insert or remove the threaded fastener.

The lock pin for securing the lock shaft to the gripper head is controlled by a mechanism consisting of a plunger pin which disengages the lock pin during collet securing, release, or exchange operations and simultaneously locks the gripper head to the power pack. The plunger pin is controlled by a lead screw driven by a small motor.

This tool is designed for zero-gravity operation with a remote manipulator system that has a means for gripping the tool and a means for remotely making electrical connection between the manipulator system and the tool. The tool can also be used in hand-held operations and is especially useful where the fastener cannot be manipulated directly.

DETAILED DESCRIPTION OF THE INVENTION AND BEST MODE FOR CARRYING OUT THE PREFERRED EMBODIMENT

Figure 1:
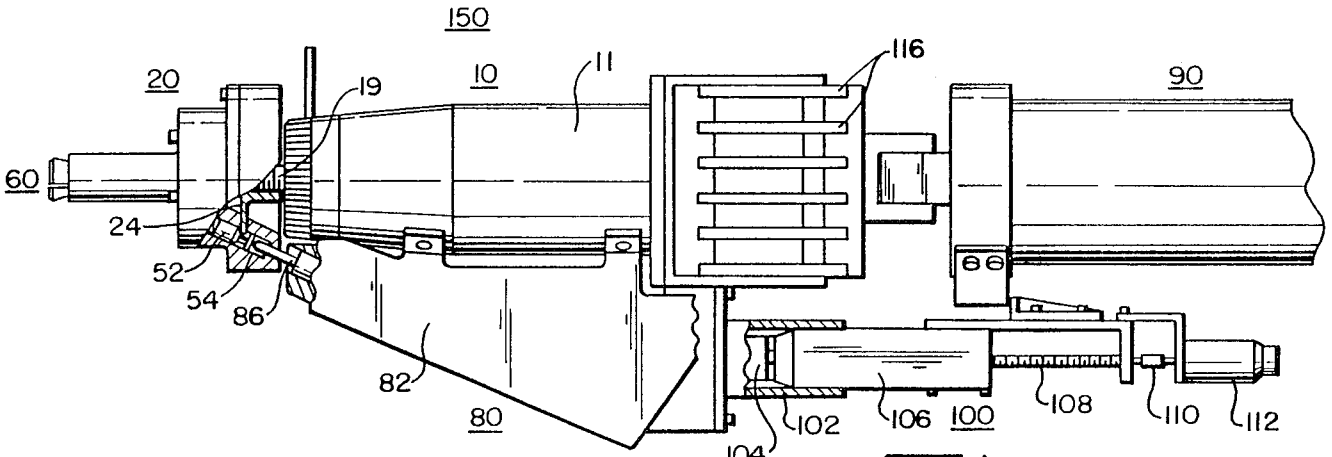
FIG. 1 is a partially cut away side view of a power tool constructed in accordance with the principles of the present invention.

FIG. 1 shows a power tool in accordance with the principles of the present invention designed to secure, transport, insert, and remove threaded fasteners. The power tool 150 is illustrated as comprising a power pack 10, a gripper head 20, a collet 60, and lock control assembly 80. The tool is suitable for use with a robotic manipulator 90 which is equipped with means 100 for making electrical connections between the power tool 150 and robotic arm 90. The power tool handle is grasped by the robotic arm manipulator fingers 116.

The robotic arm electrical connection means 100 consists of a plug 106, a socket 102, and receptacle 104 (located on the power tool housing), and a means for remotely connecting the two (comprising a lead screw 108, a motor 112, and means 110 for connecting the two. These parts are commercially available. For example, the motor is a Gearmotor 162400+ST+1613-141:1 available from MicroMo, St. Petersburg, FL. The lead screw and nut are a Hi-Tec 90 #5706858 screw and a #5709729 nut available from the Saginaw Steering Gear Division of General Motors Co., Saginaw, MI.

Figure 2:
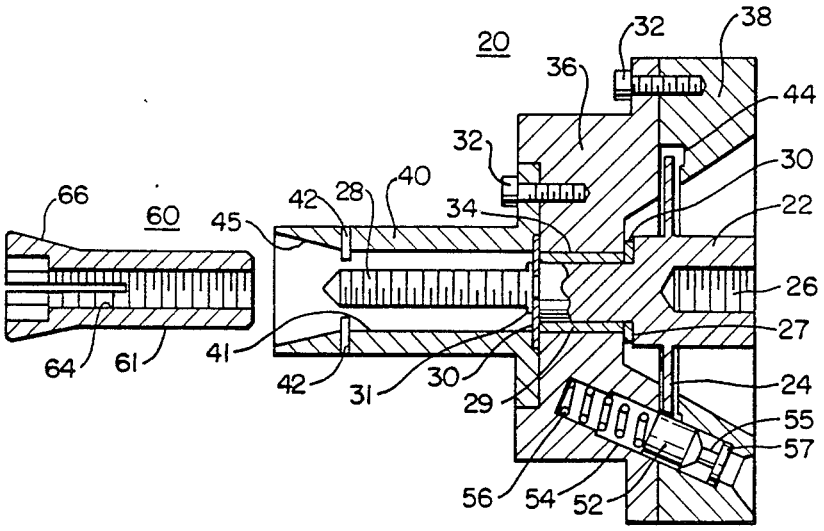
FIG. 2 is a cross-sectional side view of the gripper head and collet.
Figure 5:
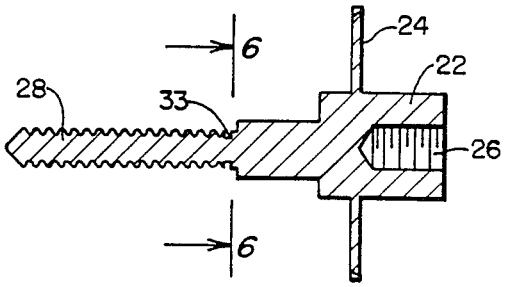
FIG. 5 is a cross-sectional side view of the lock shaft taken along line 5—5 of FIG. 6.

The power pack 10 consists of a housing 11, a gear block 12, a motor block 14, a switch block 16, and a handle 18 (all detailed in FIG. 7) and a drive shaft 19 rotatable in two directions. The power pack is based on the internal components of the commercially available AEG EZ 506 hand power tool (AEG Power Tool Corp., Norwich, CT). It is capable of forward/reverse operation, six stage torque control (4 to 57 ft./lb.), variable speed (100–600 rpm), and uses a 7.2 VDC motor. As shown in FIG. 2, the gripper head 20 consists of a rear lock shaft housing 38, a forward lock shaft housing 36, and a collet support flange 40 all of which are rigidly fasten together by suitable means such as socket-head or machine screws 32. The drive shaft 19 of the power pack is threaded into the mating threaded bore 26 of the lock shaft 22. This lock shaft 22 is radially supported in the forward lock shaft housing 36 by a bushing 29 and coaxially secured at one end of housing 36 by a thrust washer 30 and a shoulder 27 on the lock shaft of larger diameter than the axial bore 34 of housing 36 and at the other end of housing 36 by a thrust washer 3C and a retaining ring 31 partially contained in a radial 33 (FIG. 5) on the lock shaft 22. The serrated disk 24 (FIGS. 1, 2, 5, and 6) turns freely in a coaxial circular bore 44 in the rear, lock-shaft housing 38. The threaded shaft 28 of the lock shaft 22 is contained in the collet flange 40.

Figure 3:
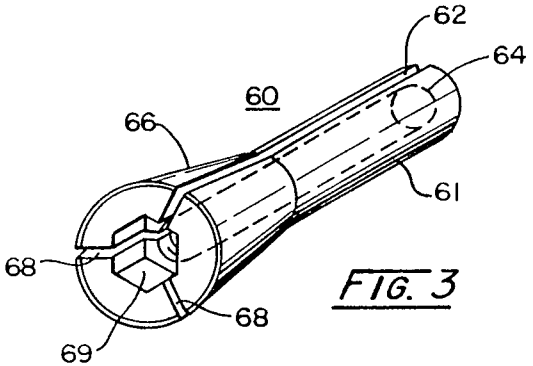
FIG. 3 is a perspective view of the collet.

The bore 41 of the collet support flange 40 mates with the outer diameter of the collet 60 and allows for the free axial movement of the collet shaft 61 within the bore 41. Two anti-rotation pins 42 (FIG. 2) engage grooves 62 (FIG. 3) in the collet 60 and serve to prevent rotation of the collet shaft 61 in the collet support flange bore 41. The collet support flange bore 41 gradually increases in diameter at its outer end 45 to accept the increasing radius of the collet head 66. Typically, the rate of increase of the diameter of the collet flange bore is less than that of the rate of increase of the diameter of the collet head 66 so that a radial force is exerted on the collet head 66 as it is being drawn into the collet flange bore 41 thereby causing the collet head 66 to squeeze the fastener head (not shown).

The collet 60 shown in FIGS. 1, 2, 3 and 4 has a threaded inner bore 64 mating with the threaded shaft 28 of the lock shaft 22. The head 66 of the collet 60 contains slits 68 that allow the collet head 66 to compress and squeeze a fastener head (not shown) positioned in the socket-head type recess 69 of the collet 60. The sockethead-type recess 69 is of a cross-section such as to mate with the cross section of the fastener head which is to be gripped.

Figure 4:
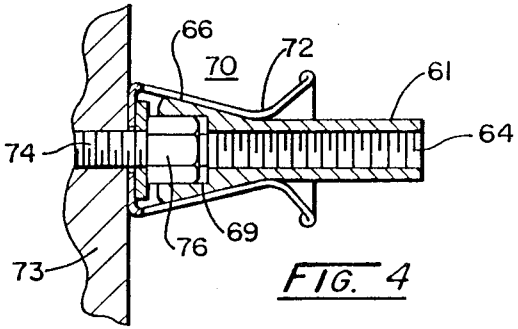
FIG. 4 is a cross-sectional side view of the collet in the collet holder.

As shown in FIG. 4, the collet holder 70 consists of two U-shaped spring clips 72 placed at right angles to each other (one clip not shown). The legs of the clip initially bend inwards to conform to the collet head 66 and firmly secure it therein. Thereafter, the legs bend outwardly as an aid in inserting the collet head 66 in the collet holder 70. A fastener with a fastener head 76 of such cross section as to mate with a cross section of the socket-head recess 69 in the collet head 66 is used to secure the base of the collet holder to a supporting member such as bulkhead 73. On insertion into the holder 70, the socket-head recess 69 engages the fastener head 76 of the holder securing bolt 74 thereby preventing rotation of the collet after the collet is pushed out of the collet support flange 40 beyond the anti-rotation pins 42.

Figure 6:
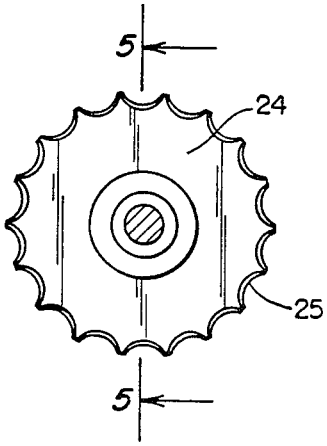
FIG. 6 is a sectional end view of the serrated locking disk taken along line 6—6 of FIG. 5.

As shown in FIG. 2, the lock pin 52 is movably housed in a cylindrical bore 54 ia the forward and rear lock shaft housings 36 and 38. In the locked position, the lock pin 52 mates with a serration 25 (FIG. 6) of the lock shaft serrated disk 24. The lock pin 52 mates with a serration 25 at an angle and therefore the edge of the lock shaft serrated disk is machined at an angle to contact the lock pin throughout the width of the edge (FIG. 6). As shown in FIG. 2, the lock pin has a constricted diameter 55 near one end to allow the serrated disk 24 to rotate freely when the lock pin 52 is disengaged from the serrated disk 24. The cylindrical bore 54 is closed at one end to contain the lock spring 56 that maintains the lock pin 52 in the locked position with serrated disk 24. A coaxial shoulder 59 at the opposite end of the cylindrical bore 54 limits the axial travel of lock pin 52 while permitting plunger pin 86 to enter the cylindrical bore 54 and disengage lock pin 52 from the locked position with the serrated disk 25.

Figure 8:
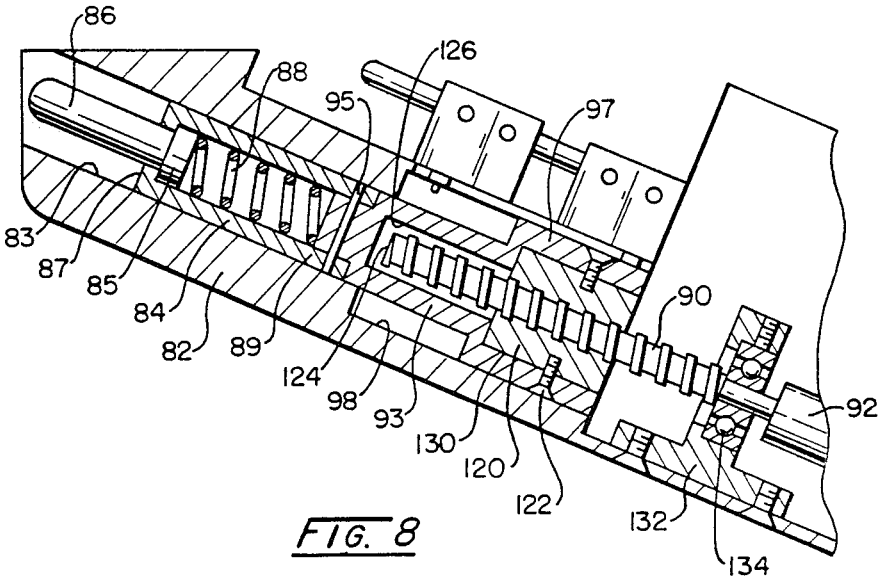
FIG. 8 is an enlarged cross-sectional side view of the lock control mechanism.

As shown in FIG. 8, the plunger pin 86 is retained in the cylindrical housing 84 by means of a flange 85 located at one end of the plunger pin 86 which engages the circular shoulder 87 located at one end of the cylindrical housing 84. The inner diameter of the shoulder 87 is of such size as to prevent the flange 85 from passing through the opening formed by the shoulder 87. The other end of the cylindrical housing is closed by the nose 89 of the lead screw nut housing 93 that extends into the housing 84 and is secured thereto by lock pin 95.

A radially enlarged rear portion 97 of the lead screw nut housing 93 travels axially in the cylindrical bore 98. The exterior of the cylindrical housing 84 and the center portion of the lead screw nut housing 93 are of such diameters as to permit free axial movement within the cylindrical bore 83.

A lead screw nut 120 is secured to the enlarged inner bore 130 of the lead screw nut housing 97 by suitable means such as flat head machine screws 122. One end 124 of the lead screw 90 is capable of extending beyond the lead screw nut 120 into the interior bore 126 of the lead screw housing 97.

Figure 7:
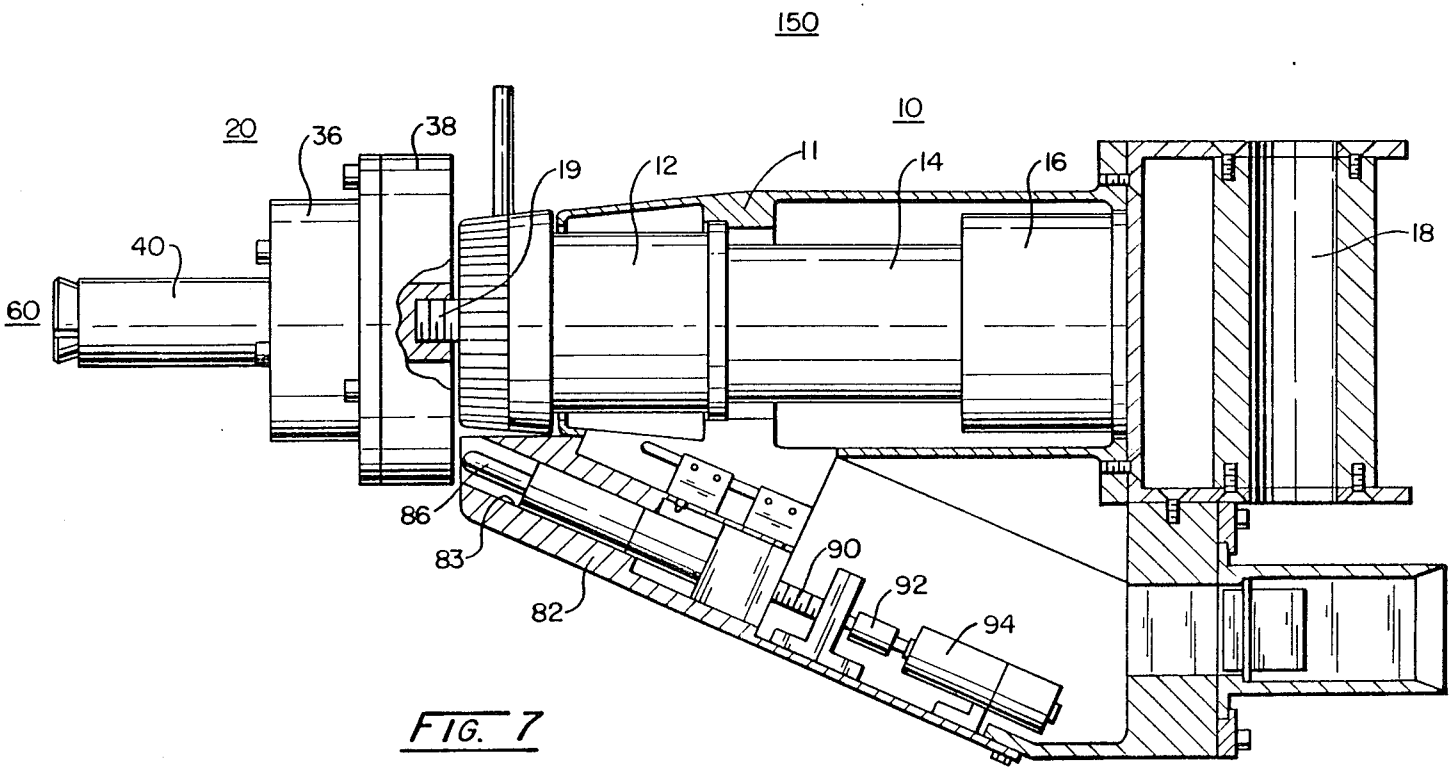
FIG. 7 is a partially cut away side view of the device showing the lock control mechanism.

As shown in FIGS. 7 and 8, the plunger pin 86 is contained within the cylindrical bore 83 in the lock control mechanism housing 82 when the lock pin 52 has engaged and is locked with the serrated disk 24 (FIG. 2). In this position, the gripper head 20 is free to rotate (FIG. 7). As shown in FIG. 1, when the plunger pin 86 enters the cylindrical bore 54 to disengage the lock pin 52 from the serrated disk 24, it locks the gripper head 20 to the power pack 10 and lock control mechanism 80. Axial movement of the plunger pin assembly comprising the plunger 86, plunger housing 84, the lead screw nut housing 93, and the lead screw nut 120, is controlled by a lead screw 90 connected to a motor 94 by a suitable coupling 92. The lead screw, motor, coupling and other related parts are commercially available and are generally known to those skilled in the art. For example, the motor is a Gear Motor 1212-1213-104:1 available from MicroMo, St Petersburg, Fla.; the lead screw and coupling nut are screw #5706858 and nut #5709729 available from Saginaw Steering Division of General Motors, Saginaw, Mich. Axial travel of the plunger is controlled by limit switches 96 (Microswitch 15X1-T Microswitch, Inc. Freeport, Ill.). A plunger pin spring 88 is placed between the plunger pin 86 and the lead screw nut housing 93 so as to maintain a positive force on the plunger pin so that the plunger pin may enter the lock pin cylindrical bore 54 when it comes into coaxial alignment with the lock pin bore 54. The spring rate of the lock pin spring 56 is greater than the spring rate of the plunger pin spring 88 so as to maintain the lock pin 52 in the lock position when no force is being exorted by the lead screw 90. A ball bearing housing 132 and ball bearings 134 stabilize and permit free rotations of lead screw 90.

OPERATION OF THE INVENTION

During a typical operating cycle, an empty collet support flange 40 engages the collet shaft 61. The lead screw 90 is caused to rotate out of the lead screw nut 120 thereby causing the plunger pin 86 to enter the lock pin bore 54 and disengage the lock pin 52 from the serrated disk 24 of the lock shaft 22 while simultaneously locking the gripper head 20 to the power pack 10 (FIG. 1). In this position, the threaded lock shaft 22 is free to rotate within the gripper head 20 and engages and screws into the threaded bore 64 of the collet 60 drawing the collet into the collet support flange 40. After the collet has been secured in the collet support flange, the collet is withdrawn from the collet holder 70. The collet fastener head recess 69 is than mated with a secured fastener head and the threaded lock shaft 22 rotated so as to further draw the collet into the collet support flange 40 causing the collet head 66 to squeeze and secure the fastener head as radial force is exerted by the collet support flange 40 on the collet head 66.

The lead screw 90 then is rotated in a reverse direction causing the plunger pin 86 to be withdrawn from the lock pin bore 54. The lock pin spring forces the lock pin 52 to engage a serration 25 on the lock shaft 22 and lock the lock shaft to the gripper head 20 with the withdrawal of the plunger pin from the lock pin bore 54, the gripper head 20 is released from its locked position with the power pack 10. In this position, the gripper head 20, which is locked to the lock shaft 22, is free to rotate and unscrew the secured fastener. Once the fastener is free, it may be transported to a new site where it is screwed in by reversing the direction of the power pack drive shaft 19.

After the fastener is secure, the plunger pin 86 is caused again to enter the lock pin bore 54 and disengage the lock pin 52 while at the same time securing the gripper housing 20 to the power pack 10. In this position, the lock shaft 22 is free to turn and the grip on the fastener can be released by partially rotating the lock shaft 22 out of the collet 60. The collet is then guided into the collet holder 70 where it is secured by the spring clips 72. The lock shaft then is completely rotated out of the collet and the device is free to engage another collet.

While the forms of the invention herein disclosed constitute presently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

We claim:

1. A rotary power tool for engaging, securing, removing, transporting, reinserting, and releasing fasteners comprising:

a. a rotary power pack operably connected to a drive shaft rotatable in two directions;

b. a fastener gripper head comprising:

(1) a lock shaft coaxially attached at a first end to said power pack drive shaft and having a coaxial serrated lock disk, (2) a lock-shaft housing radially supporting said lock shaft, and (3) a cylindrical collet support flange (a) attached at a first end to said lock-shaft housing, (b) radially surrounding the second end of said lock shaft, and (c) having a radially increasing opening at the second end;

c. a lock pin movably and radially supported and contained in a cylindrical bore in said lock shaft housing and comprising:

(1) one portion with a diameter so as to engage and lock with a serration on said serrated lock disk, and (2) a second intermediate portion of a diameter so as to permit free rotation of said serrated lock disk;

d. means for engaging and disengaging said lock pin with said serration of said lock shaft serrated disk;

e. a collet compromising:

(1) a first end longitudinally movable within said collet support flange and coaxially attached to the second end of said lock shaft by suitable means and (2) a second end with a head comprising:

(a) a gradually increasing radius in the direction of said second end, (b) a recess with such cross section as to mate with a fastener head of similar cross section, and (c) at least one longitudinal slit, and (3) means for longitudinally moving said collet in and out of said collet support flange.

2. The invention as described in claim 1 further comprising means for preventing rotation of said collet within said collet support flange.

3. The rotary power tool described in claim 2 with said rotation prevention means comprising at least one longitudinal external slot in said collet that mates with an anti-rotation pin projecting from said collet support flange.

4. The rotary power tool described in claim 1 wherein said lock-pin cylindrical bore has:

(a) a closed end, (b) an open end of a diameter less than said lock pin diameter through which said means for engaging and disengaging said lock pin with said serration in said lock shaft serrated disk engages a first end of said lock pin, and (c) a coaxial lock pin spring located between said closed end of said cylindrical bore and the second end of said lock pin.

5. The rotary power tool described in claim 4 wherein said means for engaging and disengaging said lock pin with said serration in said lock shaft serrated disk is a plunger pin and means for longitudinal movement thereof.

6. The rotary power tool as described in claim 5 wherein said plunger pin movement means is a lead screw and means for driving said screw.

7. The rotary power tool as described in claim 6 wherein said lead screw drive means is a reversible motor.

8. The apparatus as described in claim 4 with said means for engaging and disengaging said locking pin with said serration in said lock shaft serrated disk comprising:

(a) a lock control housing with a cylindrical bore, (b) a cylindrical plunger pin housing longitudinally movable in said control housing bore and having a cylindrical bore with a shoulder at a first end, (c) a cylindrical lead-screw nut housing with a solid first end and means for securing said first end to the second end of said plunger pin housing, (d) a lead screw nut and means for securing it in a bore of said lead-screw nut housing by suitable means, (e) a lead screw engaging said lead screw nut, (f) means for rotating said lead screw in opposite directions, (g) a plunger pin having a first end of a diameter so as to enter said lock shaft cylindrical bore and disengage said lock pin from said serration of said serrated disk and having a flanged second end retained in said plunger housing by said housing shoulder, and (h) a coaxial plunger pin spring located in said plunger pin housing between said plunger pin flange and said solid end of said lead-screw nut housing.

9. The rotary power tool described in claim 8 wherein said lock pin spring has a greater spring rate than said plunger pin spring.

10. The rotary power tool described in claim 1 wherein said longitudinal movement of said lock pin engaging and disengaging means is controlled by limit switches.

11. The rotary power tool of claim 1 with said power head further comprising;

(a) a handle for robotic manipulation, (b) an electrical connector, and (c) means for remote connection of said electrical connector to a power source.

12. The rotary power tool described in claim 1 wherein said means for attaching said power head drive shaft to said lock shaft is a threaded means.

13. The rotary power tool described in claim 1 wherein said means for connecting said collet to said lock shaft and for longitudinally moving said collet within said collet support flange is a threaded means.

14. The rotary power tool as described in claim 1 wherein said lock shaft is secured at a first end of an axial bore through said lock-shaft housing by means of a shoulder on said lock shaft of diameter greater than the diameter of said axial bore and at the other end of said axial bore by means of a retainer ring.

15. The rotary power tool as described in claim 14 and having a tubular bushing between said lock-shaft housing and said lock shaft.

16. The rotary power tool as described in claim 14 and having thrust washers between said lock-shaft housing and said lock-shaft shoulder and between said lock-shaft housing and said retainer ring.

17. In combination, A. a rotary power tool having a collet for securing, holding, and releasing a fastener and B. a collet holder for securing the rotary power tool collet and preventing its rotation while changing rotary power tool collets and for storing unused collets comprising:

A. a rotary power tool for engaging, securing, removing, transporting, reinserting, and releasing fasteners comprising:

1. a rotary power pack operably connected to a drive shaft rotatable in two directions;
2. a fastener gripper head comprising:
   a. a lock shaft coaxially attached at a first end to said power pack drive shaft and having a coaxial serrated lock disk.
   b. a lock-shaft housing radially supporting said lock shaft, and
   c. a cylindrical collet support flange
      1. attached at a first end to said lock-shaft housing,
      2. radially surrounding the second end of said lock shaft, and
      3. having a radially increasing opening at the second end;
3. a lock pin movably and radially supported and contained in a cylindrical bore in said lock shaft housing and comprising:
   a. one portion with a diameter so as to engage and lock with a serration on said serrated lock disk, and
   b. a second intermediate portion of a diameter so as to permit free rotation of said serrated lock disk;
4. means for engaging and disengaging said lock pin with said serration of said lock shaft serrated disk;
5. a collet comprising:
   a. a first end longitudinally movable within said collet support flange and coaxially attached to the second end of said lock shaft by suitable means and
   b. a second end with a head comprising:
      1. a gradually increasing radius in the direction of said second end,
      2. a recess with such cross section as to mate with a fastener head of similar cross section, and
      3. at least one longitudinal slit and
   c. means for longitudinally moving said collet in and out of said collet support flange and;

d. means for preventing collet rotation within said collet support flange comprising at least one longitudinal external slot in said collet that mates with an anti-rotation pin projecting from said collet support flange and B. a collet holder comprising:

1. at least one U-shaped spring clip with legs extending initially inwardly so as to contact, conform to, and secure said collet head and then said legs extending outwardly,
2. means for securing said clip to a supporting member and
3. means for preventing collet rotation after said collet has been pushed out of said collet support flange beyond said anti-rotation pin.

18. The rotary power tool and collet holder combination described in claim 4 wherein said clip securing means and said means for preventing collet rotation is a fastener having a head mating with said collet head recess.

19. A rotary power tool for engaging, securing, removing, transporting, reinserting, and releasing fasteners in humanly inaccessible, difficultly accessible, or remote environments comprising:

a. a rotary power pack and drive shaft, b. a fastener head gripping means comprising:

1. a collet
2. a lock shaft coaxially attached at a first end to said drive shaft and at a second end to said collet,
3. a lock-shaft housing radially supporting said lock shaft,
4. a cylindrical collet support flange
   a. attached at a first end to said lock-shaft housing,
   b. radially surrounding the second end of said lock shaft, and
   c. having a radially increasing opening at the second end and
5. means for longitudinally moving said collet in said collet support flange and c. means for securing, rotating and unsecuring a fastener in said fastener head gripping means.

20. The rotary power tool as described in claim 19 with said collet further comprising:

(a) a first end longitudinally movable within said collet support flange, (b) means for attaching said first end to the second end of said lock shaft, and (c) a head of gradually increasing radius toward the second end, said head further comprising:

(1) at least one longitudinal slit and (2) a cross-section recess for mating with a fastener head of similar cross-section.

21. The rotary power tool as described in claim 20 wherein said means for longitudinally moving said collet within said collet support flange is a threaded means.

22. The rotary power tool as described in claim 19 with said means for securing, rotating, and unsecuring a fastener in said fastener head gripping means comprising:

(a) a lock pin movably and radially supported and contained in a cylindrical bore in said gripper head housing and further comprising:

(1) one portion with a diameter so as to engage and lock with a serration on a coaxial serrated lock disk on said lock shaft and (2) a second intermediate portion of a second diameter so as to permit free rotation of said serrated lock disk and (b) a means for engaging and disengaging said lock pin with said serration in said lock shaft serrated disk.

23. The rotary power tool as described in claim 22 with said engaging and disengaging means comprising:

(a) a plunger pin axially moveable in a cylindrical bore of a lock control housing affixed to said power pack and (b) means for engaging and disengaging said plunger pin with said lock pin so as to disengage or engage said lock pin with said serrated disk serration.

24. The rotary power tool as described in claim 23 wherein said plunger pin engaging and disengaging means is a lead screw and reversible motor.

* * * * *